US010193218B2

(12) United States Patent
Baron et al.

(10) Patent No.: US 10,193,218 B2
(45) Date of Patent: Jan. 29, 2019

(54) STRUCTURAL REINFORCEMENT FOR AN ANTENNA SYSTEM ON AN AIRCRAFT

(71) Applicant: The Boeing Company, Chicago, IL (US)

(72) Inventors: John Patrick Baron, Bothell, WA (US); Steve J. Avila, Renton, WA (US); Randy L. Parrott, Maple Valley, WA (US); Timothy Allen Caviness, Maple Valley, WA (US); Darin Richard Pankratz, Bothell, WA (US)

(73) Assignee: The Boeing Company, Chicago, IL (US)

( * ) Notice: Subject to any disclaimer, the term of this patent is extended or adjusted under 35 U.S.C. 154(b) by 109 days.

(21) Appl. No.: 15/193,461

(22) Filed: Jun. 27, 2016

(65) Prior Publication Data

US 2017/0373383 A1 Dec. 28, 2017

(51) Int. Cl.

| | |
|---|---|
| ***H01Q 1/12*** | (2006.01) |
| ***H01Q 1/28*** | (2006.01) |
| ***H01Q 1/50*** | (2006.01) |
| ***H01Q 1/42*** | (2006.01) |

(52) U.S. Cl.

CPC ..... *H01Q 1/286* (2013.01); *H01Q 1/42* (2013.01); *H01Q 1/50* (2013.01)

(58) Field of Classification Search

CPC ... H01Q 1/12; H01Q 1/28; H01Q 1/42; Y10T 29/49016

See application file for complete search history.

(56) References Cited

U.S. PATENT DOCUMENTS

| | | | | |
|---|---|---|---|---|
| 2,700,104 A * | 1/1955 | Bowman | H01Q 1/287 | 343/705 |
| 3,151,327 A * | 9/1964 | Levy | H01Q 1/283 | 343/705 |
| 3,725,938 A * | 4/1973 | Black | G01S 1/02 | 342/434 |
| 5,191,349 A * | 3/1993 | Dinsmore | H01Q 1/28 | 343/751 |

(Continued)

OTHER PUBLICATIONS

Pietila et al., "Integrated Low Profile Phased Array Antenna System," U.S. Appl. No. 14/827,941, filed Aug. 17, 2015, 56 pages.

*Primary Examiner* — Tho G Phan
(74) *Attorney, Agent, or Firm* — Yee & Associates, P.C.

(57) ABSTRACT

A method and apparatus for retrofitting an aircraft. Connection points for a reinforcement structure are located. The reinforcement structure is associated with the airframe during original manufacturing of the aircraft and accommodates forces from an antenna system attached to the reinforcement structure. The antenna system includes an antenna selected from a plurality of types of antennas. An antenna adapter plate in the antenna system is attached to the reinforcement structure connected to the airframe of the aircraft during the original manufacturing of the aircraft using the connection points. The antenna is attached to the antenna adapter plate, wherein the antenna adapter plate is configured to receive any one of the plurality of types of antennas. The reinforcement structure is configured to handle loads from any one of the plurality of types of antennas and the antenna adapter plate attached to the connection points.

24 Claims, 16 Drawing Sheets

(56) References Cited

U.S. PATENT DOCUMENTS

| | | | | |
|---|---|---|---|---|
| 5,886,671 | A * | 3/1999 | Riemer | H01Q 1/28 342/368 |
| 9,614,272 | B2 * | 4/2017 | Wallace | H01Q 1/28 |
| 2015/0130672 | A1 * | 5/2015 | Cordone | H01Q 1/28 343/705 |
| 2015/0207214 | A1 | 7/2015 | Wallace | |

* cited by examiner

STRUCTURAL REINFORCEMENT FOR AN ANTENNA SYSTEM ON AN AIRCRAFT

BACKGROUND INFORMATION

1. Field

The present disclosure relates generally to antenna systems and, in particular, to antenna systems for aircraft. Still more particularly, the present disclosure relates to a method and apparatus for attaching an antenna system to an aircraft.

2. Background

Manufacturing aircraft is a complex process. For example, in manufacturing a commercial airplane, hundreds of thousands or millions of parts are manufactured and assembled to form a commercial airplane. Additionally, inspections are performed on the parts and the assembly of parts. The time to manufacture a commercial airplane may be from about eight months to about ten months, depending on the particular type of airplane.

When a customer orders a commercial airplane, the customer selects a model and also may select different options or customizations for the commercial airplane. For example, the customer may select locations for laboratories, galleys, closets, and other structures or monuments in an airplane. As another example, the customer may select a particular type of in-flight entertainment system for an airplane. Another option includes providing communications and Internet access to passengers. This option includes selecting a type of antenna, such as a Ka-band antenna or a Ku-band antenna, which is used to provide connectivity to the Internet or other networks while the aircraft is in flight.

Selecting these and other options may be performed prior to beginning manufacturing of the airplane. In some cases, the customer may wish to delay some decisions on options and make those decisions later while the aircraft is being manufactured. However, decisions on some options may have to be made within certain dates to avoid delays in the manufacturing of the aircraft.

As a result, the customer sometimes may be unable to add or change a particular option when the date for making that decision has passed. Therefore, it would be desirable to have a method and apparatus that take into account at least some of the issues discussed above, as well as other possible issues. For example, it would be desirable to have a method and apparatus that overcome a technical problem with increasing flexibility for customers selecting options for an aircraft.

SUMMARY

An embodiment of the present disclosure provides an apparatus comprising a reinforcement structure that is associated with an airframe for a fuselage of an aircraft and connection points on the reinforcement structure. The reinforcement structure is configured to accommodate forces from an antenna system attached to the reinforcement structure. The antenna system includes an antenna selected from a plurality of types of antennas. The connection points are for attachment of an antenna adapter plate in the antenna system in which the antenna adapter plate is configured to receive any one of the plurality of types of antennas.

Another embodiment of the present disclosure provides an antenna system comprising an antenna adapter plate, lugs, and a group of concentric pins. The antenna plate is configured to receive any one of a plurality of types of antennas used to provide a communications link to the Internet. The lugs are lugs configured to be attached to connection points on a reinforcement structure associated with an airframe of an aircraft. The reinforcement structure is configured to accommodate forces from any one of the plurality of types of antennas. The group of concentric pins is configured to connect a group of the connection points to the lugs.

Yet another embodiment of the present disclosure provides a method for retrofitting an aircraft. Connection points are located for a reinforcement structure associated with an airframe of the aircraft. The reinforcement structure is associated with the airframe during manufacturing of the aircraft and accommodates forces from an antenna system attached to the reinforcement structure. The antenna system includes an antenna selected from a plurality of types of antennas. An antenna adapter plate in the antenna system is attached to the reinforcement structure connected to the airframe of the aircraft during original manufacturing of the aircraft using the connection points. The antenna is attached to the antenna adapter plate, wherein the antenna adapter plate is configured to receive any one of the plurality of types of antennas. The reinforcement structure is configured to handle loads from any one of the plurality of types of antennas and the antenna adapter plate attached to the connection points.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account one or more different considerations. For example, the illustrative embodiments recognize and take into account that selecting an antenna system for an aircraft by a particular date is currently necessary during manufacturing of the aircraft. The illustrative embodiments recognize and take into account that currently the design of the fuselage is made to take into account a particular antenna that may be mounted to the aircraft. For example, a particular model of an aircraft may have several options for the structure of the fuselage based on what type of antenna that is to be attached to the fuselage of the aircraft. Those embodiments recognize and take into account that these types of structural options for the structure of the fuselage take into account forces that may be encountered for different types of antennas.

The illustrative embodiments recognize and take into account that if an antenna is not selected for the aircraft early enough in the manufacturing process, adding the antenna at a later time during the manufacturing is impossible without an extremely expensive and time-consuming rework that results in delays during the manufacturing. For example, the illustrative embodiments recognize and take into account that the frame of the aircraft often needs reinforcements and other modifications to accommodate an antenna. The illustrative embodiments recognize and take into account that adding these reinforcements or modifications may result in delays and increased expenses if an option for the antenna is selected after the fuselage has been substantially or entirely completed. Further, even if the manufacturing of the fuselage has not been completed or has not started, the illustrative embodiments recognize and take into account that manufacturing or ordering the parts needed may also result in increased expenses and delays.

Thus, the illustrative embodiments provide a method and apparatus for manufacturing an aircraft for which antenna options may be selected at different times during manufacturing. Further, the illustrative embodiments also may be used to retrofit an aircraft to include an antenna after the aircraft has been completed.

In one illustrative example, an apparatus comprises a reinforcement structure and connection points. The reinforcement structure is associated with an airframe for a fuselage of an aircraft. The reinforcement structure is configured to accommodate forces from an antenna system attached to the reinforcement structure, and the antenna system includes an antenna selected from a plurality of types of antennas. The connection points are on the reinforcement structure. The connection points are for attachment of an antenna adapter plate in the antenna system in which the antenna adapter plate is configured to receive any one of the plurality of types of antennas.

Figure 1:
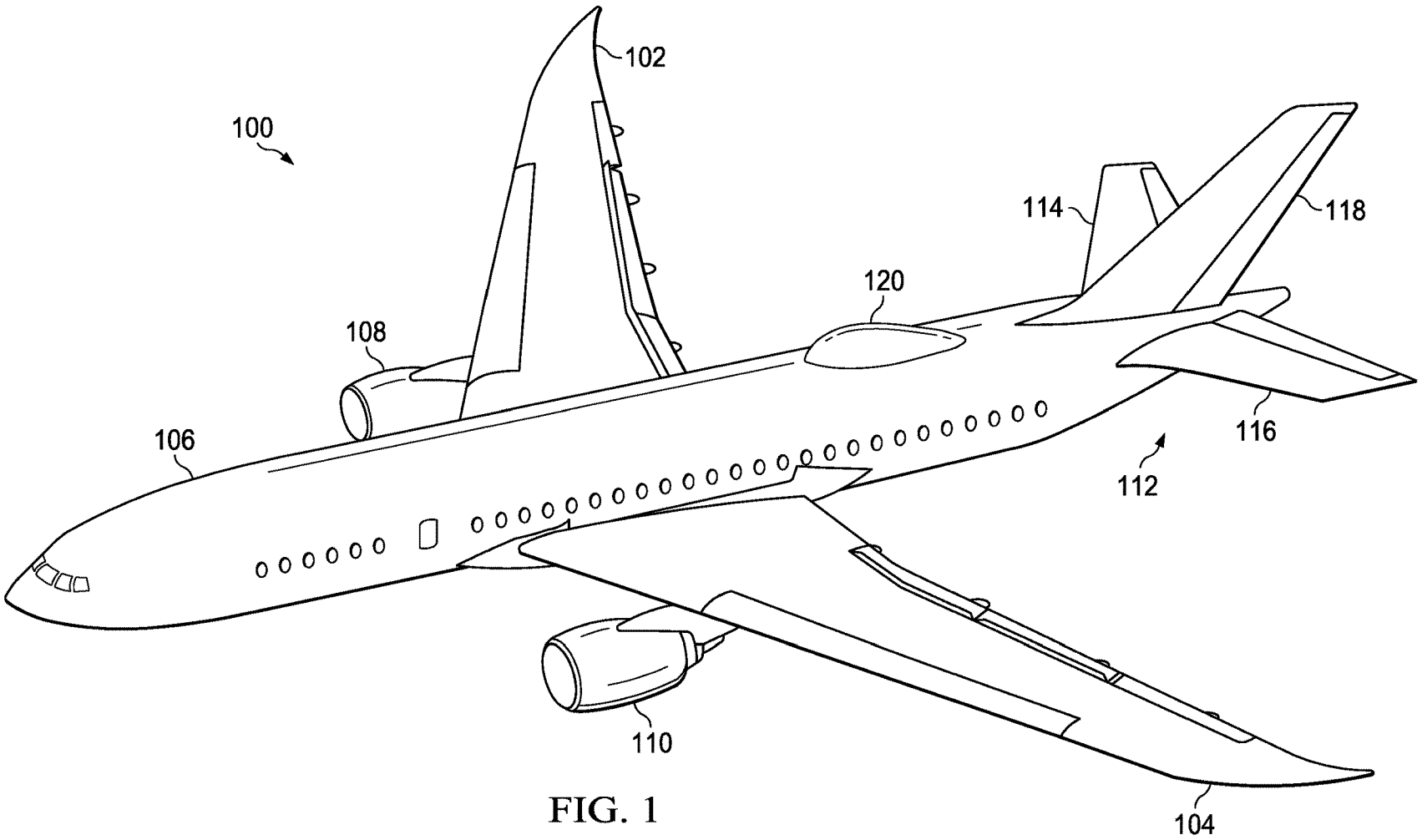
FIG. 1 is an illustration of an aircraft in accordance with an illustrative embodiment.

With reference now to the figures and, in particular, with reference to FIG. 1, an illustration of an aircraft is depicted in accordance with an illustrative embodiment. In this illustrative example, aircraft 100 has wing 102 and wing 104 attached to fuselage 106. Aircraft 100 includes engine 108 attached to wing 102 and engine 110 attached to wing 104.

Fuselage 106 has tail section 112. Horizontal stabilizer 114, horizontal stabilizer 116, and vertical stabilizer 118 are attached to tail section 112 of fuselage 106.

Aircraft 100 is an example of an aircraft in which antenna system 120 may be implemented in accordance with an illustrative embodiment. As depicted, fuselage 106 is designed to accommodate the plurality of different types of antenna systems of which any one of which may be selected for use as antenna system 120. With this type of configuration for fuselage 106, antenna system 120 may be selected for aircraft 100 at almost any time during the manufacturing of aircraft 100.

Further, antenna system 120 may be selected and attached to aircraft 100 after aircraft 100 has been in service. This attachment of antenna system 120 may be performed as a retrofit during maintenance of aircraft 100 in a manner that is less expensive and complex than attempting to add reinforcements and other structures needed when a fuselage is not configured to receive different types of antenna systems.

Figure 2:
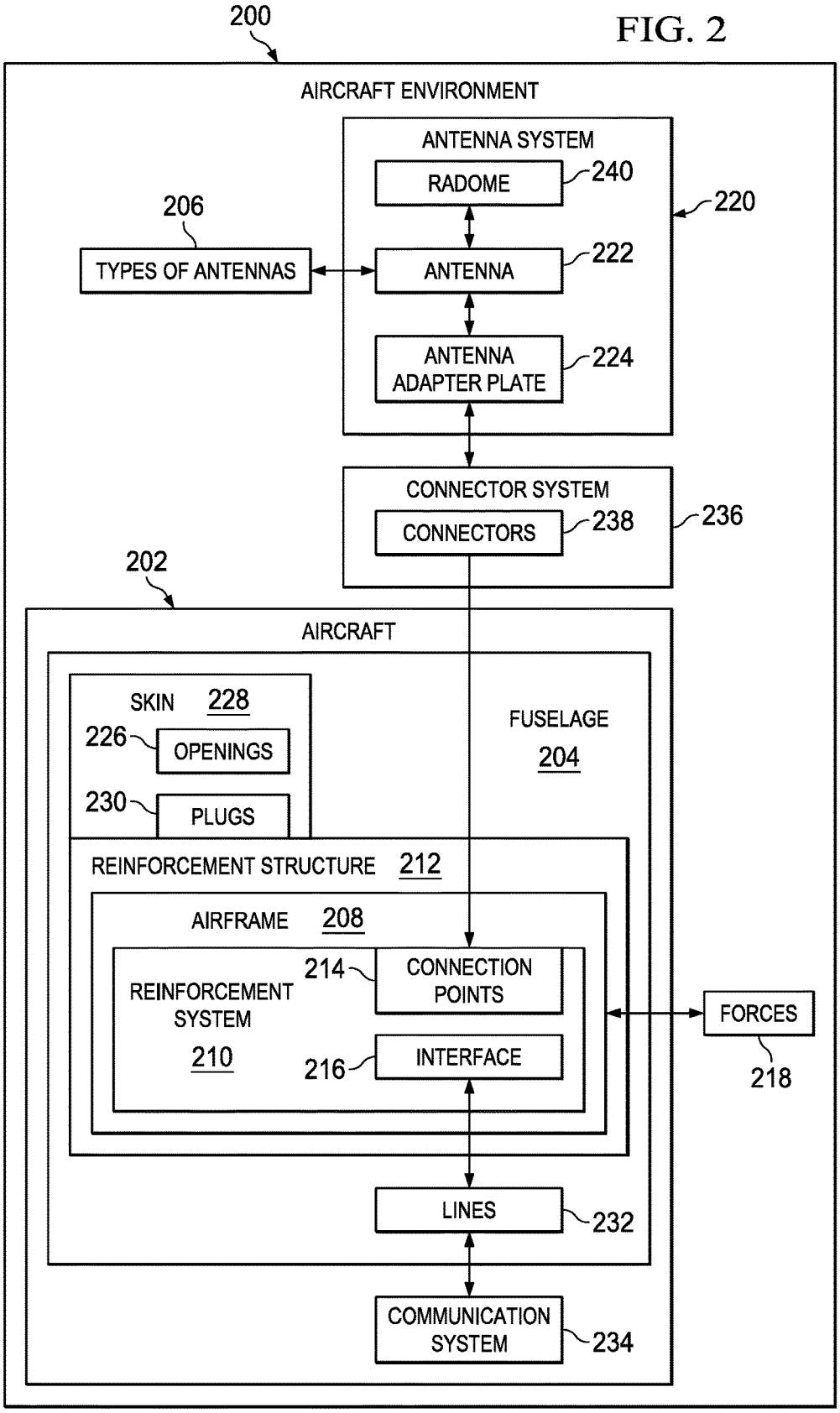
FIG. 2 is an illustration of a block diagram of an aircraft environment in accordance with an illustrative embodiment.

With reference now to FIG. 2, an illustration of an aircraft environment is depicted in accordance with an illustrative embodiment. In this illustrative example, aircraft environment 200 includes aircraft 202. Aircraft 100 in FIG. 1 is an example of one implementation for aircraft 202 shown in block form in this figure. Aircraft 202 may take a number of different forms. For example, aircraft 202 may be a commercial airplane, a rotorcraft, a military aircraft, a business jet, or some other suitable type of aircraft.

In this illustrative example, fuselage 204 may be manufactured in a manner such that any one of a plurality of types of antennas 206 may be selected for use on aircraft 202. As depicted, the plurality of types of antennas 206 is selected from a group comprising a Ku-band antenna, a K-band antenna, a Ka-band antenna, and other suitable types of antennas.

For example, airframe 208 may have a configuration that is configured to be used with any one of the plurality of types of antennas 206. Airframe 208 is the mechanical structure for aircraft 202. For example, airframe 208 may include at least one of a bulkhead, a frame, a longeron, a former, a stringer, a rib, or some other suitable type of structure.

As used herein, the phrase "at least one of", when used with a list of items, means different combinations of one or more of the listed items may be used, and only one of each item in the list may be needed. In other words, "at least one of" means any combination of items and number of items may be used from the list, but not all of the items in the list are required. The item may be a particular object, a thing, or a category.

For example, without limitation, "at least one of item A, item B, or item C" may include item A, item A and item B, or item B. This example also may include item A, item B, and item C or item B and item C. Of course, any combinations of these items may be present. In some illustrative examples, "at least one of" may be, for example, without limitation, two of item A; one of item B; and ten of item C; four of item B and seven of item C; or other suitable combinations.

In this illustrative example, airframe 208 also includes reinforcement system 210. Reinforcement system 210 is a structural reinforcement system for aircraft 202 and is configured to provide an ability to attach any one of the plurality of types of antennas 206 to fuselage 204. As depicted, reinforcement system 210 comprises reinforcement structure 212, connection points 214, and interface 216.

Reinforcement structure 212 is configured to accommodate forces 218 from antenna system 220 attached to reinforcement structure 212. Further, reinforcement structure 212 is also configured to accommodate forces 218 from other sources during operation of aircraft 202. The other sources may include other portions of airframe 208, pressure from within aircraft 202, pressure from outside of aircraft 202, impacts to fuselage 204, and other sources of forces 218 that may be encountered by aircraft 202.

In other words, reinforcement structure 212 allows fuselage 204 to meet specifications such as those for performance, safety, and other considerations when antenna system 220 is attached to reinforcement structure 212 in fuselage 204. In the illustrative example, forces 218 are selected from at least one of a load or a stress. As depicted, forces 218 may be caused by different events selected from at least one of a change in altitude, a bird strike, a decompression, a thermal load, or other events that may occur during operation of aircraft 202.

In the illustrative example, reinforcement structure 212 is configured to handle forces 218 that may be caused by any one of the plurality of types of antennas 206 that may be used within antenna system 220. In other words, the addition of antenna 222 changes the manner in which forces may be applied to fuselage 204 as compared to when antenna system 220 is absent. In this manner, reinforcement structure 212 may be installed prior to a selection of antenna 222 from the plurality of types of antennas 206.

In this illustrative example, reinforcement structure 212 is associated with airframe 208 during the manufacturing of aircraft 202. When one component is "associated" with another component, the association is a physical association. For example, a first component, such as reinforcement structure 212, may be considered to be physically associated with a second component, such as airframe 208, by at least one of being secured to the second component, bonded to the second component, mounted to the second component, welded to the second component, fastened to the second component, or connected to the second component in some other suitable manner. The first component also may be connected to the second component using a third component. The first component may also be considered to be physically associated with the second component by being formed as part of the second component, an extension of the second component, or both.

Reinforcement structure 212 may be a single component or formed from multiple components. For example, reinforcement structure 212 may be comprised of at least one of an intercostal, a shear tie, a frame reinforcement, a rib, or some other component that may be used to provide support for antenna 222 and other components in antenna system 220 to meet a specification. In yet another illustrative example, reinforcement structure 212 may be formed as part of airframe 208. For example, the existing structures of airframe 208 may be thickened, manufactured with different materials, include extensions, or have other changes or modifications that do not require attaching additional components to provide desired reinforcements. Further, a combination of attaching additional components and modifying existing components to airframe 208 may be used to form reinforcement structure 212.

As depicted, antenna system 220 includes antenna 222 selected from any one of the plurality of types of antennas 206. Reinforcement structure 212 is designed to provide a desired level of performance when subjected to forces 218 for any one of the plurality of types of antennas 206 that may be selected for use in antenna system 220.

As depicted, connection points 214 are located on reinforcement structure 212. Connection points 214 are for attachment of antenna adapter plate 224 in antenna system 220. Antenna adapter plate 244 is configured to receive antenna 222 selected from any one of the plurality of types of antennas 206. As depicted, antenna 222 is attached to antenna adapter plate 224.

In this illustrative example, connection points 214 may be in communication with the exterior of aircraft 202 through openings 226 in skin 228 on airframe 208 for fuselage 204 of aircraft 202. Connection points 214 are covered by plugs 230 installed in skin 228 of fuselage 204 during the manufacturing of aircraft 202. Plugs 230 may be selected from at least one of a structure, a sealant, or some other material that may be used to fill holes that may be in skin 228. As depicted, plugs 230 are removed prior to installing antenna 222.

In the illustrative example, interface 216 is located in reinforcement structure 212. Interface 216 is configured to receive a group of lines 232 for the plurality of types of antennas 206. The group of lines 232 is connected to communications system 234 in aircraft 202. The group of lines 232 may be selected from at least one of a cable, a wire, an optical fiber, or some other line that may be used to carry at least one of power, data, or other signals.

As depicted, communications system 234 is a network that provides Internet access within aircraft 202. Additionally, communications system 234 also may provide for voice communications within aircraft 202. These types of communications may be provided to at least one of a crew or passengers in aircraft 202. For example, the plurality of types of antennas 206 may be configured to provide communications to at least one of a passenger cabin or a flight deck in aircraft 202 through a connection to communications system 234. Communications system 234 may include at least one of wireless communications links or wired communication links. Access to these links may be provided through at least one of network adapter ports or wireless access points.

As depicted, antenna adapter plate 224 is attached to reinforcement structure 212 by connector system 236. For example, antenna adapter plate 224 may be attached to reinforcement structure 212 by connectors 238 in connector system 236 in which connectors 238 are attached to connection points 214 and antenna adapter plate 224 is attached to connectors 238. As depicted, connectors 238 may be selected from at least one of a lug, a clevis, or some other suitable type of connector. In this example, antenna adapter plate 224 is attached to connectors 238 using fasteners selected from at least one of a group of bolts, a group of concentric pins, or some other type of fastener.

Additionally, antenna system 220 includes radome 240. As depicted, radome 240 is a structural component that functions as an enclosure for antenna 222. Radome 240 is constructed of one or more materials that reduce attenuation of electromagnetic signals that may be transmitted or received by antenna 222. Further, radome 240 is configured to facilitate transmission of electromagnetic signals from any one of a group of types of antennas 206.

In the illustrative example, one or more technical solutions are present that overcome a technical problem with increasing flexibility for customers selecting options for an aircraft. As a result, one or more technical solutions may provide a technical effect allowing customers to select antenna systems at a later point in time during the manufacturing of the aircraft without impacting the cost or time to manufacture the aircraft in an undesired manner. Further, one or more illustrative examples also provide a technical effect in which the plurality of different types of antennas may be selected for installation as part of a retrofit after the aircraft has already been in use.

The illustration of aircraft environment 200 in FIG. 2 is not meant to imply physical or architectural limitations to the manner in which an illustrative embodiment may be implemented. Other components in addition to or in place of the ones illustrated may be used. Some components may be unnecessary. Also, the blocks are presented to illustrate some functional components. One or more of these blocks may be combined, divided, or combined and divided into different blocks when implemented in an illustrative embodiment.

For example, connector system 236 is shown as separate components from reinforcement system 210 and antenna system 220. In other illustrative examples, connector system 236 may be considered part of at least one of reinforcement system 210 or antenna system 220.

Figure 3:
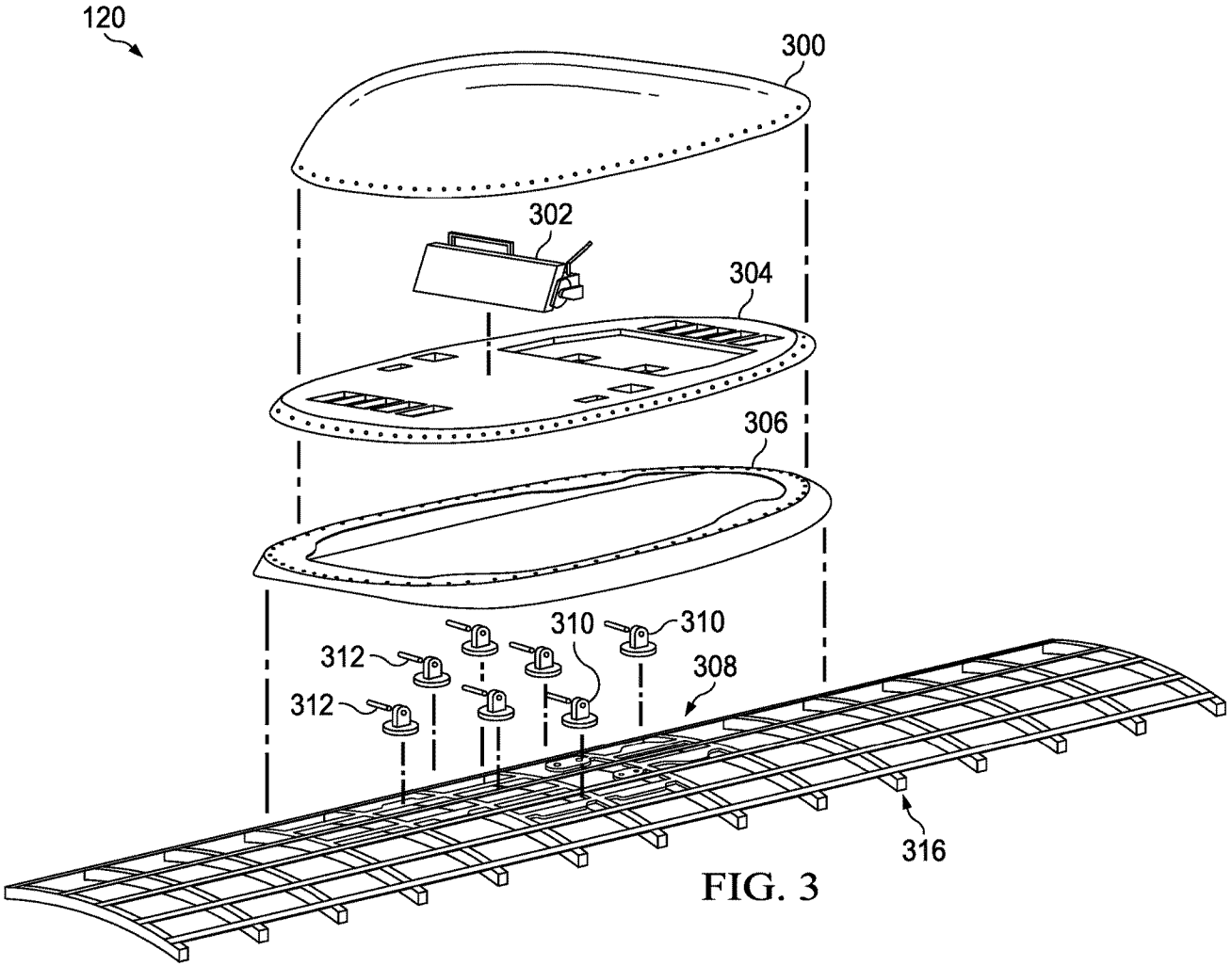
FIG. 3 is an illustration of an exploded view of an antenna system in accordance with an illustrative embodiment.

Turning now to FIG. 3, an illustration of an exploded view of an antenna system is depicted in accordance with an illustrative embodiment. In this figure, an exploded view of antenna system 120, with respect to a portion of fuselage 106 for aircraft 100 in FIG. 1, is shown.

In this exploded view, a number of different components are seen in antenna system 120. As depicted, antenna system 120 includes radome 300, antenna 302, antenna adapter plate 304, and skirt 306.

Radome 300 is a structure that covers antenna 302 when antenna 302 is attached to antenna adapter plate 304. Antenna 302 is selected from one of a plurality of types of antennas. Antenna adapter plate 304 is configured to be attached to any one of the plurality of types of antennas. Skirt 306 is a structure that seals the area around and under antenna adapter plate 304.

As depicted, lugs 310 are examples of connectors used in a connector system that connects antenna adapter plate 304 to connection points 308 on reinforcement structure 316. Lugs 310 are connected to antenna adapter plate 304 using fasteners 312.

Figure 4:
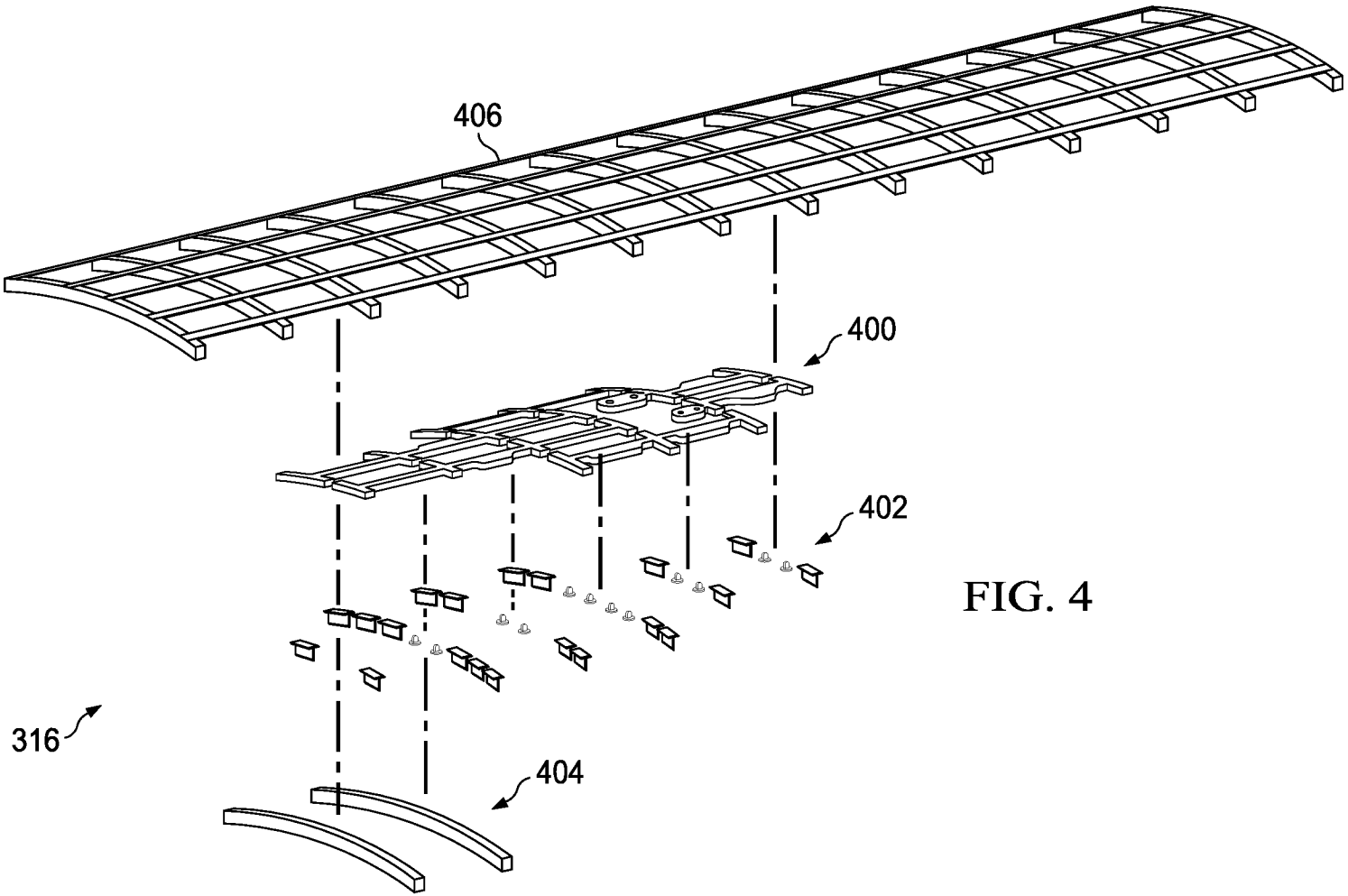
FIG. 4 is an illustration of an exploded view of a reinforcement structure in accordance with an illustrative embodiment.

With reference next to FIG. 4, an illustration of an exploded view of a reinforcement structure is depicted in accordance with an illustrative embodiment. In this figure, an exploded view of reinforcement structure 316 in FIG. 3, with respect to an exposed portion of airframe 406 for fuselage 106 of aircraft 100 in FIG. 1, is shown.

In this figure, reinforcement structure 316 includes a number of different types of components. As depicted, reinforcement structure 316 includes intercostals 400, shear ties 402, and frame reinforcements 404.

Figure 5:
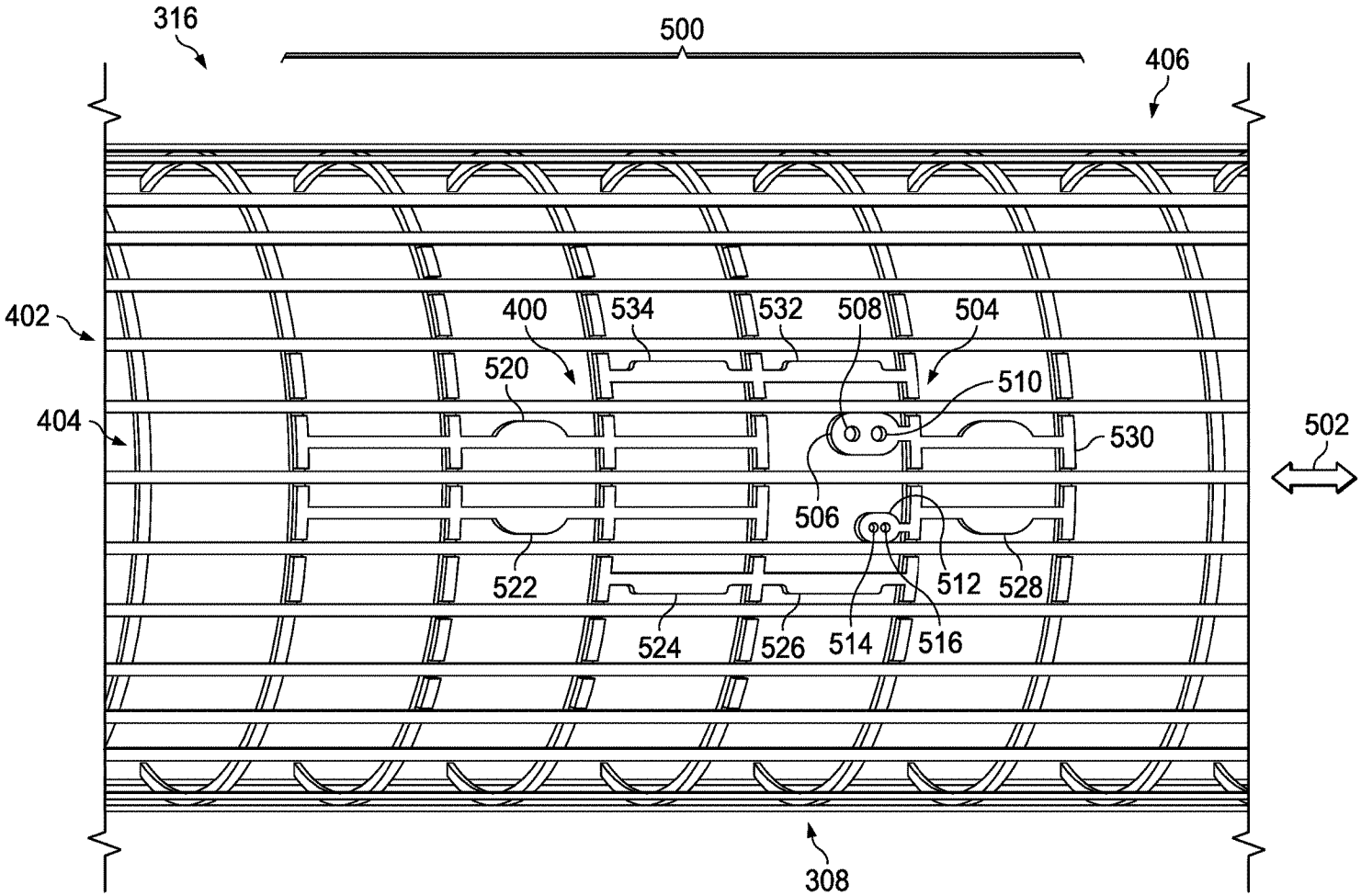
FIG. 5 is an illustration of a top view of an airframe with a reinforcement structure in accordance with an illustrative embodiment.

Turning next to FIG. 5, an illustration of a top view of an airframe with a reinforcement structure is depicted in accordance with an illustrative embodiment. Intercostals 400 provide reinforcement to frames 500 in airframe 406. Intercostals 400 may reduce movement of frames 500 in the direction of arrow 502. Intercostals 400 also may provide additional reinforcement against twisting movement of frames 500 relative to each other. Shear ties 402 and frame reinforcements 404 provide additional support for individual frames in frames 500.

These different components in reinforcement structure 316 are connected to airframe 406. In this manner, reinforcement structure 316 provides reinforcement to airframe 406 to accommodate forces that may result from attachment of antenna system 120 in FIG. 1. For example, the forces may affect airframe 406 differently because of the presence of antenna system 120.

In this illustrative example, interface 504 is depicted. Interface 504 comprises member 506 having hole 508 and hole 510. Interface 504 also includes member 512 which has hole 514 and hole 516. As depicted, hole 508, hole 510, hole 514, and hole 516 are configured to guide and allow lines from antennas to pass through airframe 406 for connection to a communications system such as a wireless or wired network within aircraft 100 in FIG. 1.

In this illustrative example, connection points 308 comprise connection point 520, connection point 522, connection point 524, connection point 526, connection point 528, connection point 530, connection point 532, and connection point 534. Connection points 308 provide locations for attaching antenna adapter plate 304 in FIG. 3 to reinforcement structure 316 using lugs 310 in FIG. 3.

Figure 6:
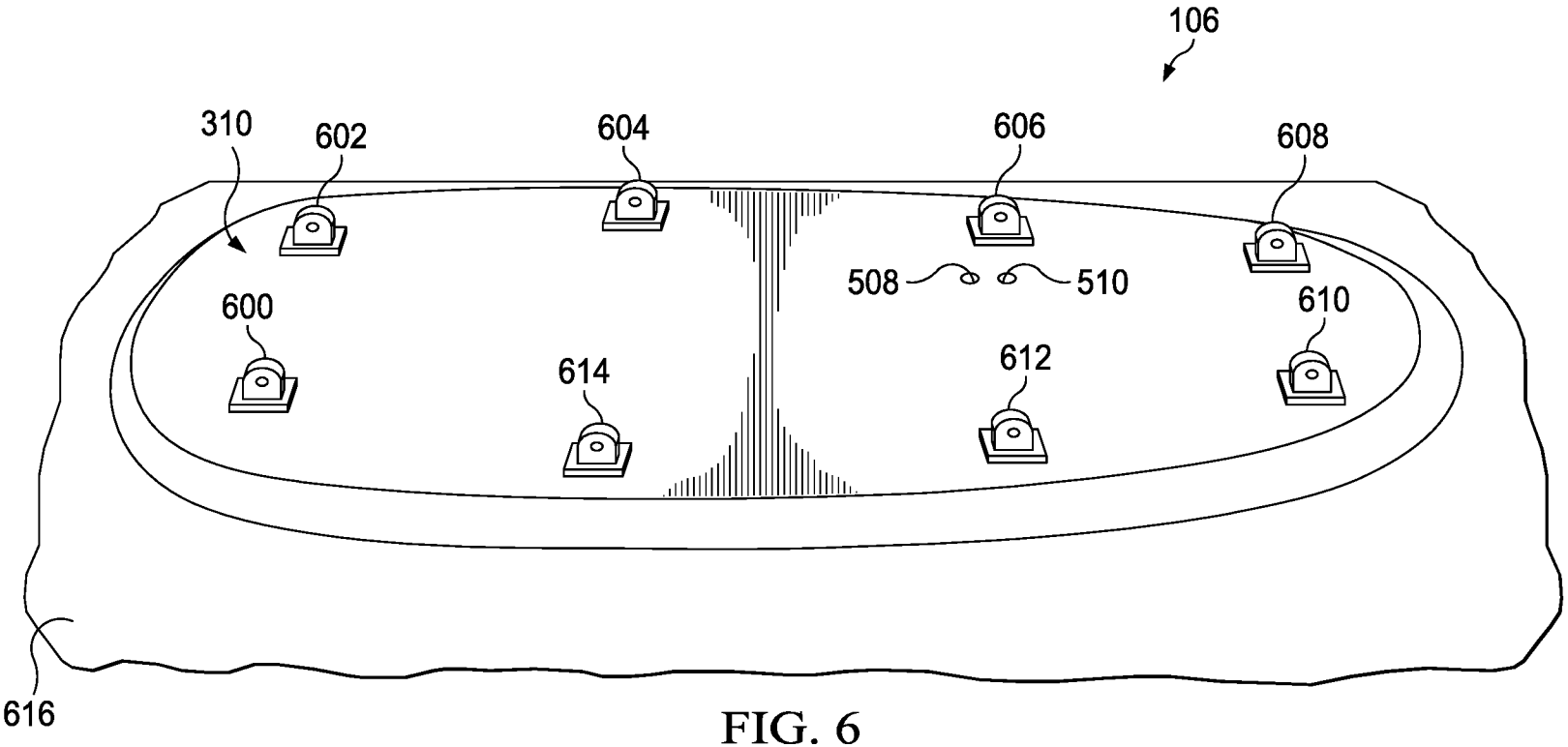
FIG. 6 is an illustration of lugs on a fuselage of an aircraft in accordance with an illustrative embodiment.

With reference now to FIGS. 6-9, illustrations of operations performed in an installation of an antenna system as a retrofit to an existing aircraft is depicted in accordance with illustrative embodiments. Turning first to FIG. 6, an illustration of lugs on a fuselage of an aircraft is depicted in accordance with an illustrative embodiment. In this illustrative example, a view of a portion of fuselage 106 with lugs 310 comprises lug 600, lug 602, lug 604, lug 606, lug 608, lug 610, lug 612, and lug 614 attached to reinforcement structure 316 (not shown) through skin 616 of fuselage 106. Antenna adapter plate 304 in FIG. 3 may be attached to lugs 310.

Also, a view of hole 508 and hole 510 through skin 616 for interface 504 in FIG. 5 is shown in this figure. Hole 514 and hole 516 are not visible in this view because plugs that cover these holes are still in place because these holes are not needed for antenna selected for use in this example.

Figure 7:
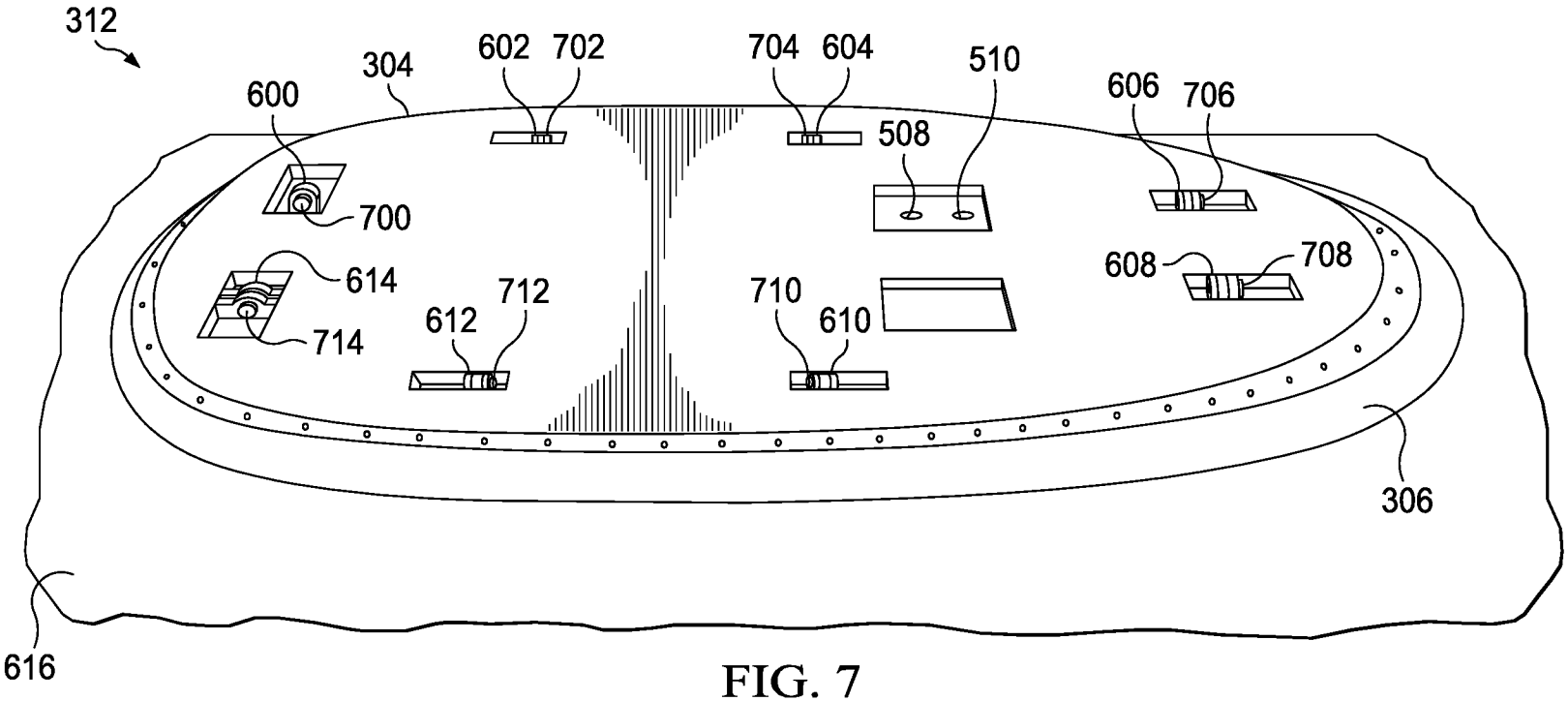
FIG. 7 is an illustration of an antenna adapter plate attached to a reinforcement structure with an illustrative embodiment.

Turning next to FIG. 7, an illustration of an antenna adapter plate attached to a reinforcement structure is depicted in accordance with an illustrative embodiment. In this depicted example, antenna adapter plate 304 is attached to lugs 310 using fasteners 312 in FIG. 3. As depicted, fasteners 312 include concentric pin 700, concentric pin 702, concentric pin 704, bolt 706, concentric pin 708, bolt 710, bolt 712, and concentric pin 714.

In this particular example, concentric pin 700 is installed in lug 600; concentric pin 702 is installed in lug 602; concentric pin 704 is installed in lug 604; bolt 706 is installed in lug 606; concentric pin 708 is installed in lug 608; bolt 710 is installed in lug 610; bolt 712 is installed in lug 612; and concentric pin 714 is installed in lug 614. A concentric pin may be used to adjust the positioning of antenna adapter plate 304 to take into account variances in tolerances.

Figure 8:
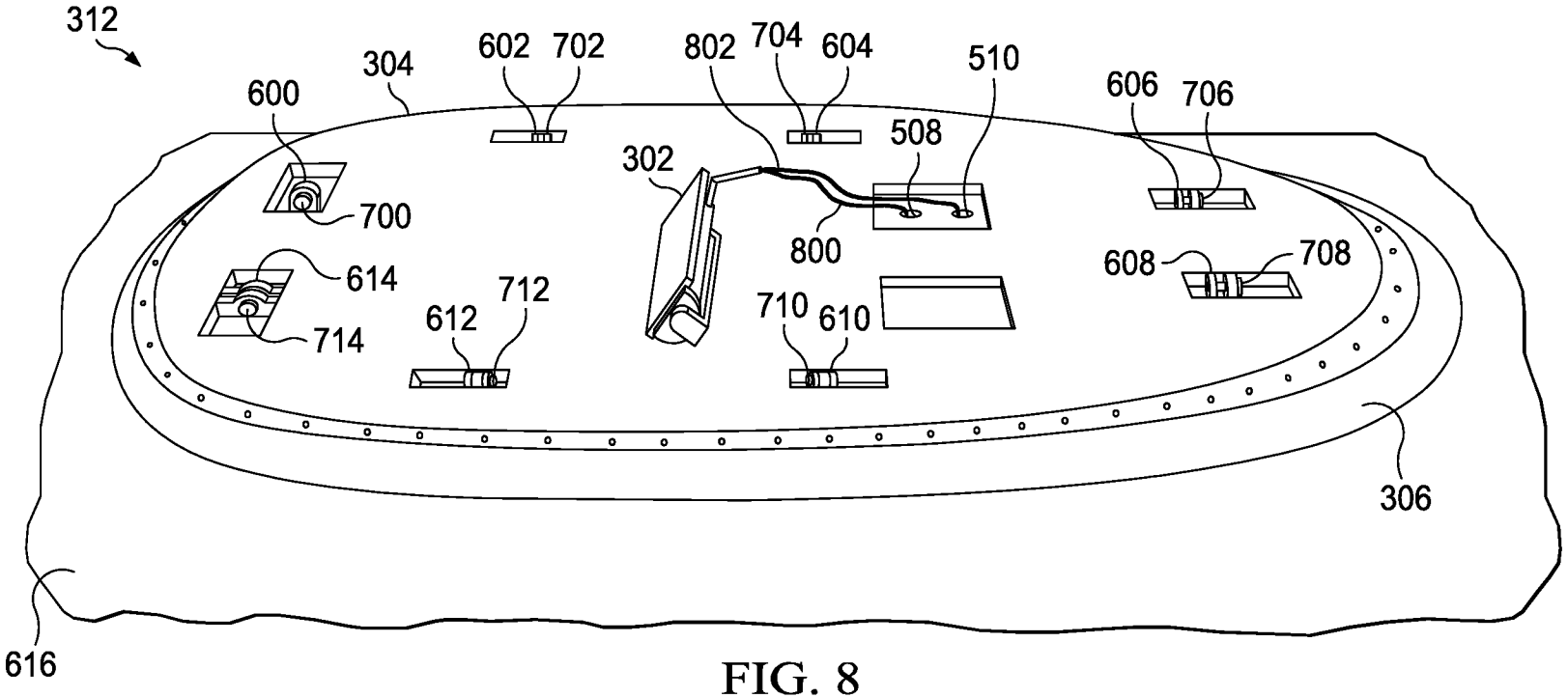
FIG. 8 is an illustration of an antenna attached to an antenna adapter plate in accordance with an illustrative embodiment.

With reference now to FIG. 8, an illustration of an antenna attached to an antenna adapter plate is depicted in accordance with an illustrative embodiment. In this figure, antenna 302 is attached to antenna adapter plate 304. Additionally, line 800 and line 802 for antenna 302 extend through hole 508 and hole 510 for connection to the communications system within the interior of the aircraft.

Figure 9:
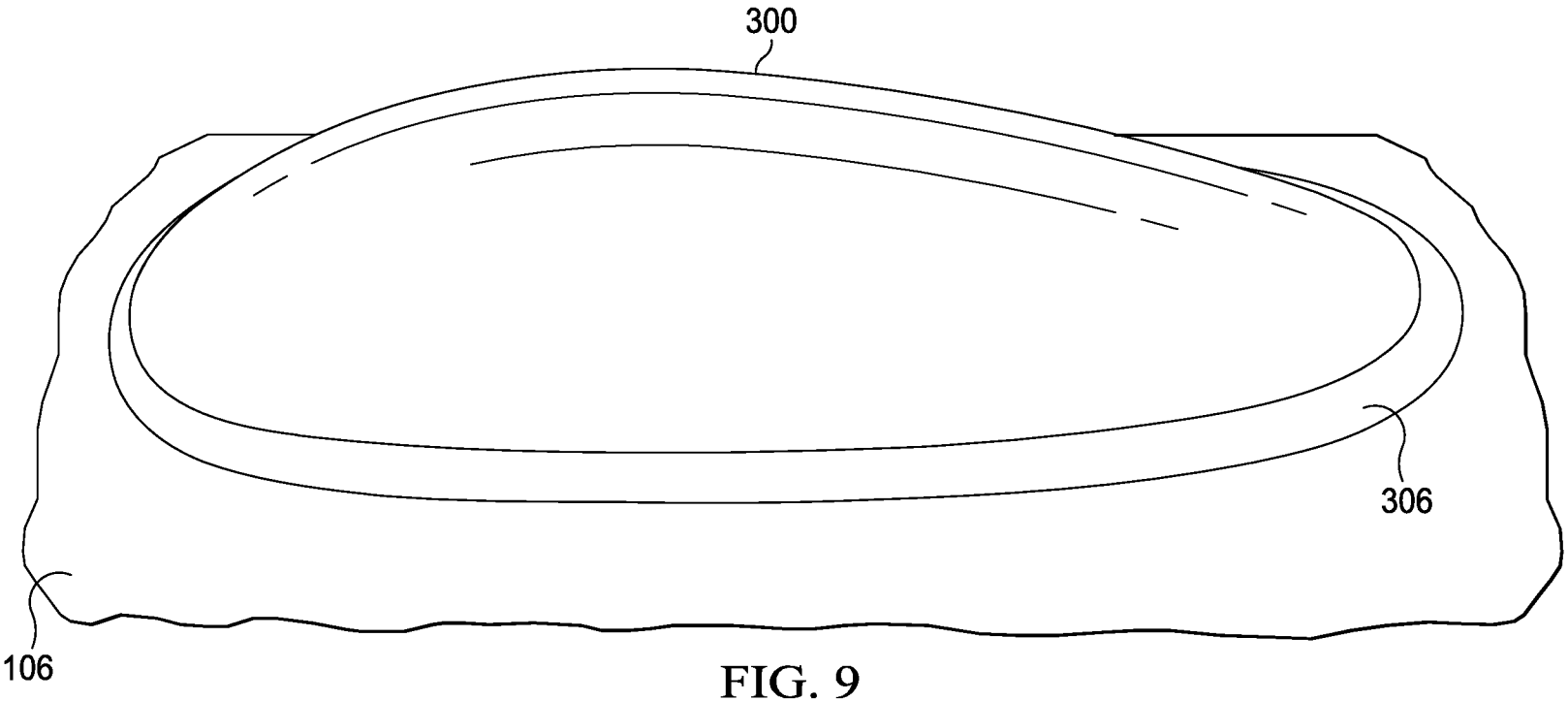
FIG. 9 is an illustration of an antenna system attached to an aircraft in accordance with an illustrative embodiment.

Turning to FIG. 9, an illustration of an antenna system attached to an aircraft is depicted in accordance with an illustrative embodiment. In this figure, radome 300 and skirt 306 are shown as installed to complete installation of the antenna system 120.

The different operations illustrated in FIGS. 6-9 are examples of only some of the operations that may be performed to attach antenna system 120 in FIG. 1 as a retrofit. Other operations may be performed in addition to or in place of the ones shown in these figures. For example, operations for applying sealants, primers, and paint also may be performed, although not shown in these figures. As another example, the attachment of skirt 306 in FIG. 3 may be omitted. Instead, skirt 306 may be formed as part of antenna adapter plate 304 in FIG. 3.

The operations depicted in FIGS. 6-9 may also be performed during manufacturing of the aircraft. The installation of reinforcement structure 316 in FIG. 3, in a manner that takes into account forces from any of a plurality of antennas that could be used for aircraft 100 in FIG. 1, allows for selecting antenna 302 in FIG. 3 at a later point during the manufacturing of the aircraft. As a result, selecting antenna 302 after aircraft 100 is substantially complete does not require extensive rework of airframe 406 in FIG. 4.

Figure 10:
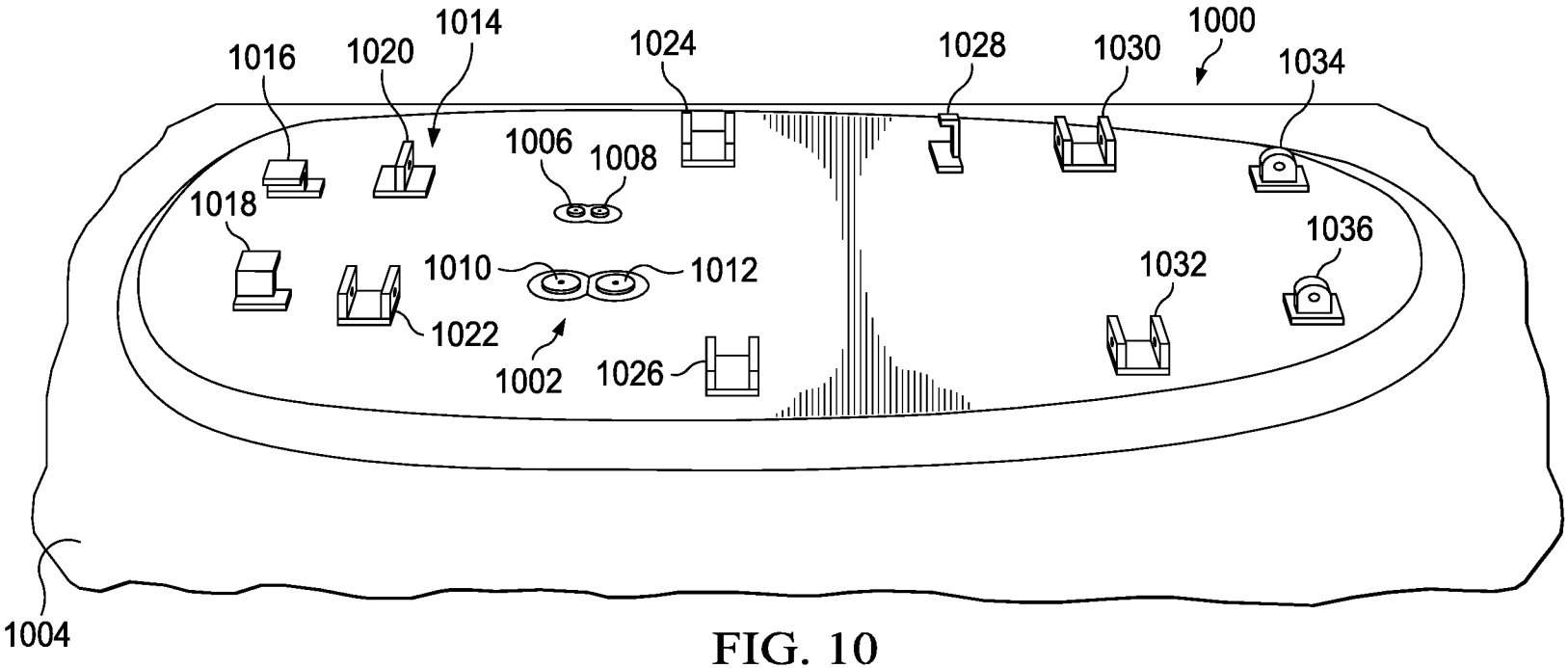
FIG. 10 is an illustration of a portion of a fuselage configured for attaching an antenna system during manufacturing in accordance with an illustrative embodiment.

With reference now to FIG. 10, an illustration of a portion of a fuselage configured for attaching an antenna system during manufacturing is depicted in accordance with an illustrative embodiment. In this example, a portion of fuselage 1000 for an aircraft is depicted to show a location where an antenna system may be installed. In this illustrative example, cover plates 1002 are shown installed on skin 1004 on fuselage 1000. Cover plates 1002 include cover plate 1006, cover plate 1008, cover plate 1010, and cover plate 1012.

Cover plates 1002 may be installed to cover holes (not shown) for lines for antenna systems. Further, the location of the holes for the antenna systems may be selected for the lines; the surrounding structure to have a desired level of structural integrity; optimizing the ability to use tools to remove and replace connectors that hold these lines in place; compatibility with different types of antennas. These locations are such that installed cover plates in the location adequately protect the interior fuselage when an antenna is not installed on the aircraft.

Installation of cover plates 1002 is optional when the customer has selected an antenna system for installation. For example, plugs may be installed in place of cover plates 1002.

In this example, the customer has selected an antenna system and lugs 1014 have been attached to the reinforcement structure (not shown) under skin 1004. In this example, lugs 1014 include lug 1016, lug 1018, lug 1020, lug 1022, lug 1024, lug 1026, lug 1028, lug 1030, lug 1032, lug 1034, and lug 1036.

Figure 11:
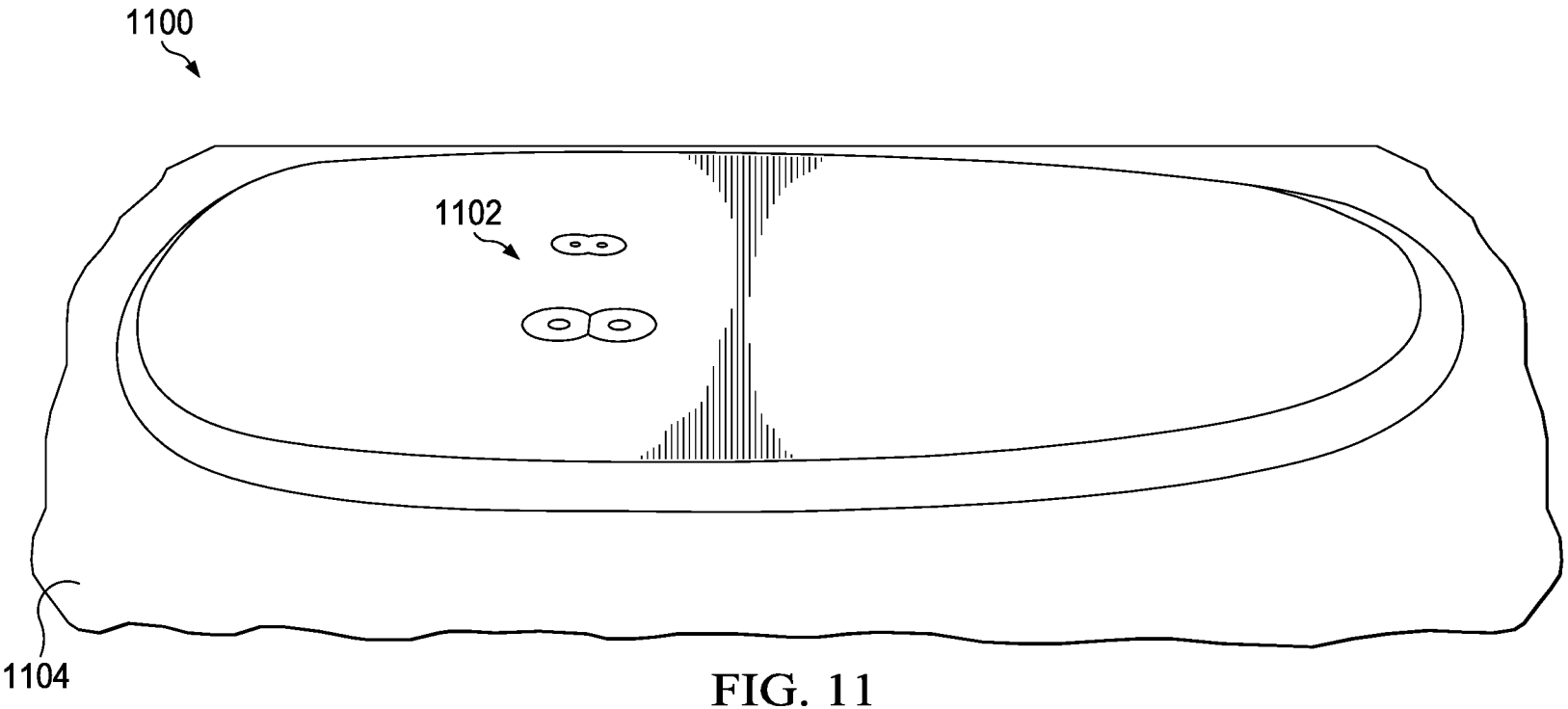
FIG. 11 is an illustration of a portion of a fuselage configured for a later installation of an antenna system after manufacturing of an aircraft in accordance with an illustrative embodiment.

With reference next to FIG. 11, an illustration of a portion of a fuselage configured for a later installation of an antenna system after manufacturing of an aircraft is depicted in accordance with an illustrative embodiment. In this illustrative example, a portion of fuselage 1100 for an aircraft is shown in a location where an antenna system may be installed at a later time. This installation may be performed as a retrofit for the aircraft to attach the antenna system to fuselage 1100.

In this example, plugs 1102 have been installed in holes for the interface and in holes for the lugs in skin 1104 of fuselage 1100. As depicted, plugs 1102 may have one or more materials and a shape that is selected to allow for paints, primers, and other coatings to be applied. As a result, plugs 1102 may be covered. In this manner, the aircraft may be used without attachment of the antenna system. The antenna system may or may not be attached to fuselage 1100 at a later point in time.

With the use of plugs, skin 1104 of fuselage 1100 may have a desired level of smoothness and aesthetics when the antenna system is not attached to fuselage 1100. Additionally, the thickness and materials used in skin 1104 may be selected to provide the desired level of smoothness for at least one of airflow or the aesthetics when the antenna system is not attached to the fuselage 1100.

Figure 12:
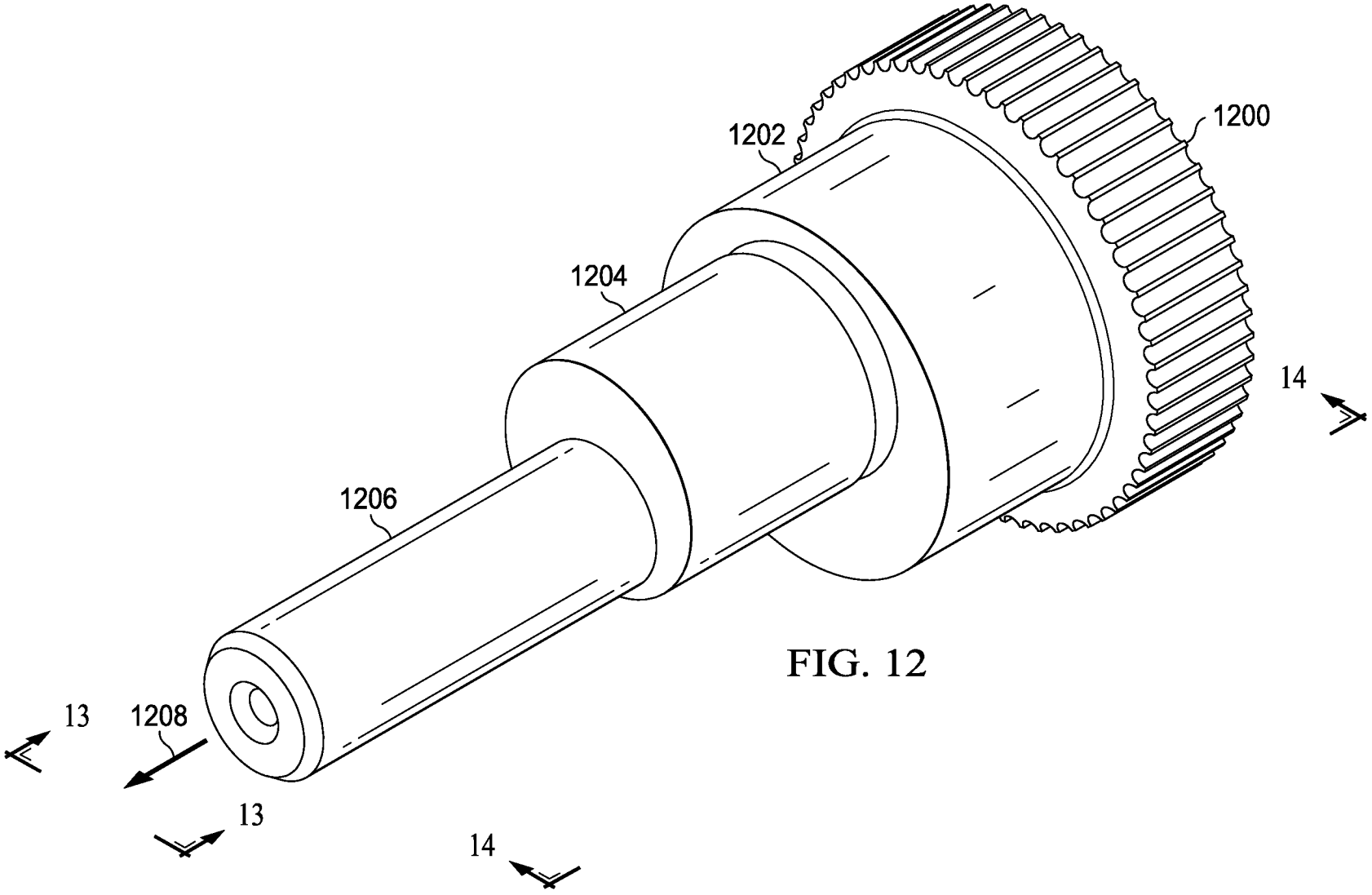
FIG. 12 is an illustration of a concentric pin in a perspective view in accordance with an illustrative embodiment.
Figure 13:
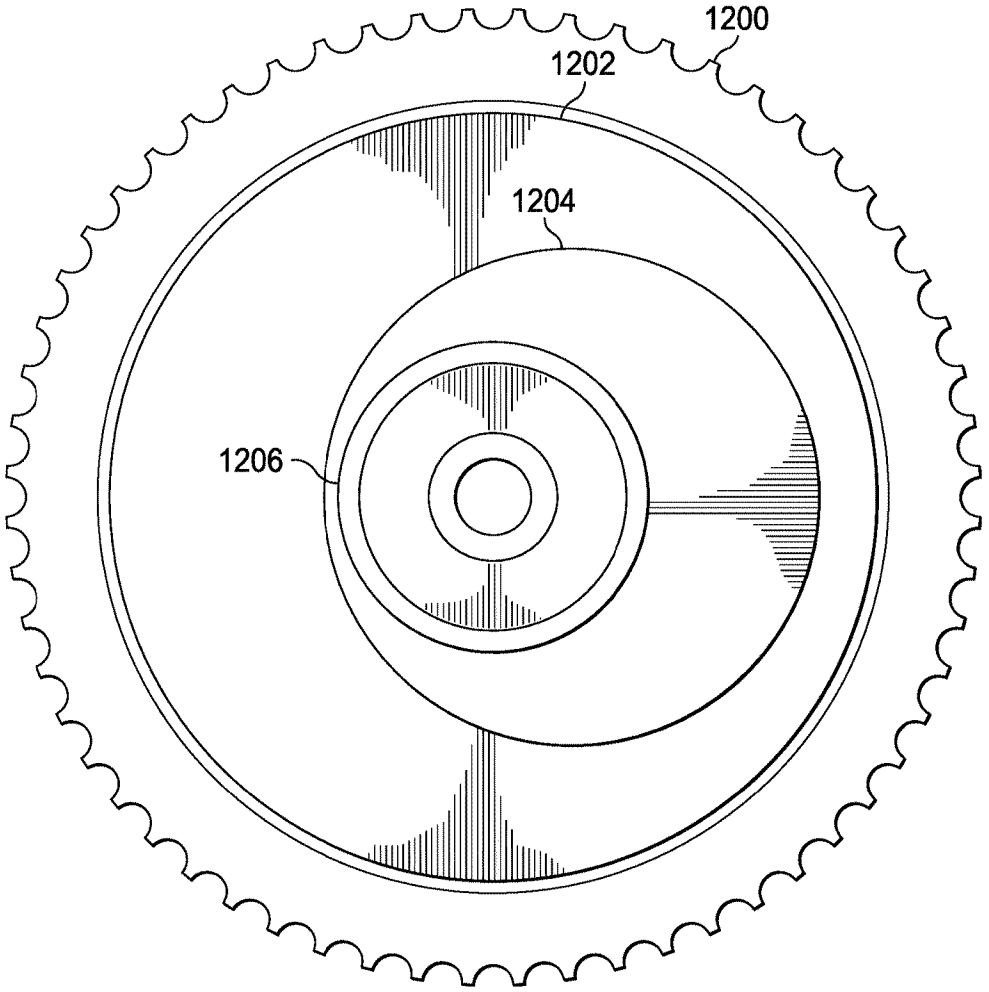
FIG. 13 is an illustration of an end of a concentric pin in accordance with an illustrative embodiment.
Figure 14:
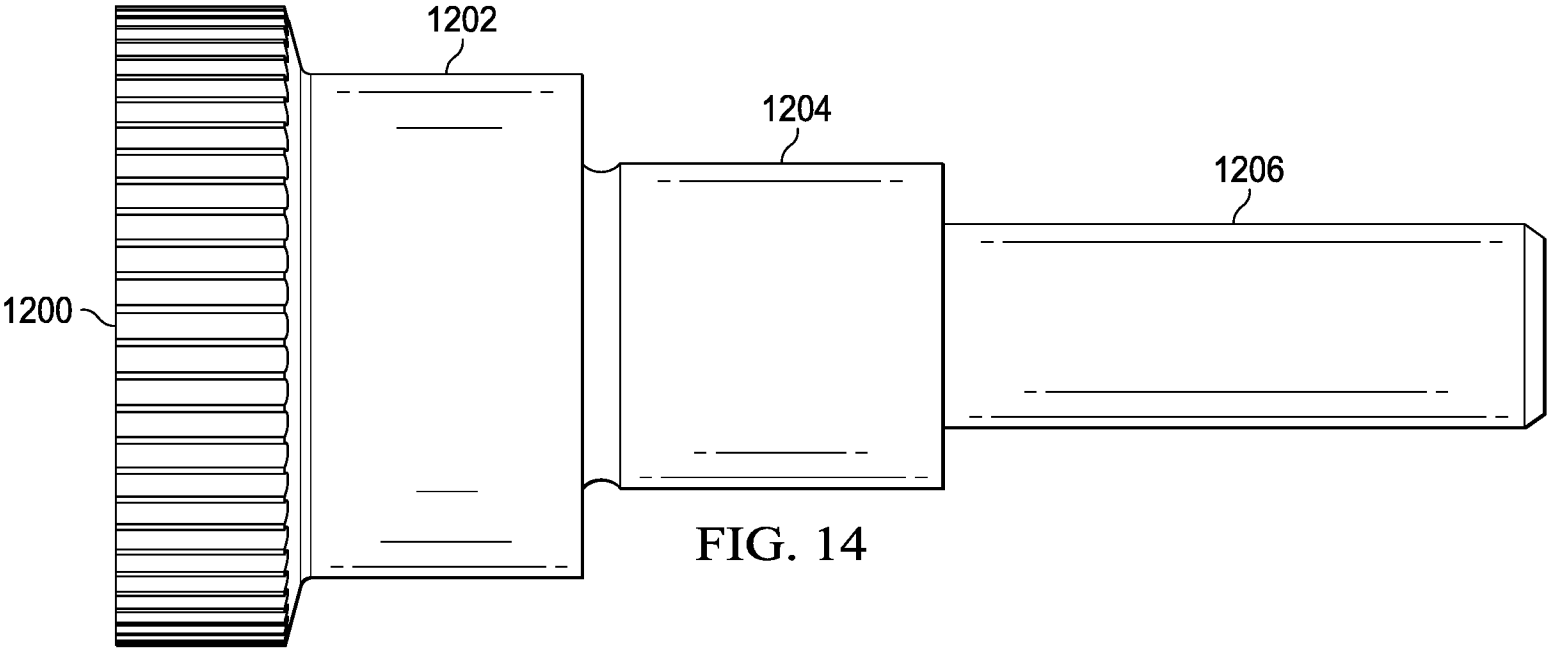
FIG. 14 is an illustration of a side view of a concentric pin in accordance with an illustrative embodiment.

With reference to FIGS. 12-14, illustrations of a concentric pin are depicted in accordance with illustrative embodiments. In FIG. 12, an illustration of a concentric pin in a perspective view is depicted in accordance with an illustrative embodiment. Concentric pin 1200 is an example of a concentric pin that may be used to implement fasteners 312 in FIG. 3. As depicted, concentric pin 1200 has section 1202, section 1204, and section 1206. These different sections allow for connecting components to each other in a manner that takes into account differences in dimensions of the components that may be within tolerances for an aircraft. A connection may be made with any one of these three sections being used to contact and connect different components.

Further, the different sections are not concentric through axis 1208. This offset from axis 1208 allows for additional fine-tuning in the spacing of the components that are fastened to each other using concentric pin 1200.

Turning now to FIG. 13, an illustration of an end of a concentric pin is depicted in accordance with an illustrative embodiment. In this example, a view of concentric pin 1200 is shown in a direction of lines 13-13 in FIG. 12.

With reference now to FIG. 14, an illustration of a side view of a concentric pin is depicted in accordance with an illustrative embodiment. In this figure, a side view of concentric pin 1200 is shown in a direction of lines 14-14 as shown in FIG. 12.

The illustrations of the different components for attaching an antenna system in FIGS. 10-14 are provided as one or more illustrative examples and not meant to limit the manner in which other examples may be implemented. For example, both plugs and cover plates may be used to provide cover for holes in a desired level of skin smoothness when an entire antenna system is not attached to a reinforcement structure in a fuselage. As another example, a concentric pin may have two sections, four sections, or some other number of sections that provides an ability to adjust the manner in which two components are connected to each other.

Figure 15:
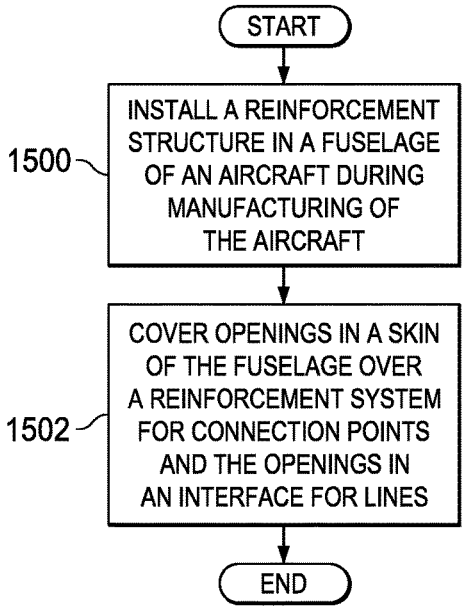
FIG. 15 is an illustration of a flowchart of a process for installing a reinforcement structure in accordance with an illustrative embodiment.

Turning next to FIG. 15, an illustration of a flowchart of a process for installing a reinforcement structure is depicted in accordance with an illustrative embodiment. The process illustrated in FIG. 15 may be implemented in aircraft environment 200 in FIG. 2 to connect reinforcement structure 212 to airframe 208 in fuselage 204 of aircraft 202.

The process begins by installing a reinforcement structure in a fuselage of an aircraft during manufacturing of the aircraft (operation 1500). The reinforcement structure is configured to accommodate forces from an antenna system attached to the reinforcement structure. The antenna system is one that may include an antenna selected from a plurality of types of antennas. The reinforcement structure is configured to handle forces for the antenna that is selected from any one of the plurality of types of antennas. In other words, the reinforcement structure is able to handle the forces in a desired manner such as meeting a specification regardless of which antenna in the plurality of types of antennas is selected for the antenna system.

The process covers openings in a skin of the fuselage over a reinforcement system for connection points and the openings in an interface for lines (operation 1502) with the process terminating thereafter. The openings may be covered using plugs or other mechanisms. Covering the openings is optionally performed when a determination is not made as to whether an antenna system will be attached to the aircraft. In this manner, the antenna system may be added later during the manufacturing or even later when the aircraft is in use as part of a retrofit of the aircraft.

Figure 16:
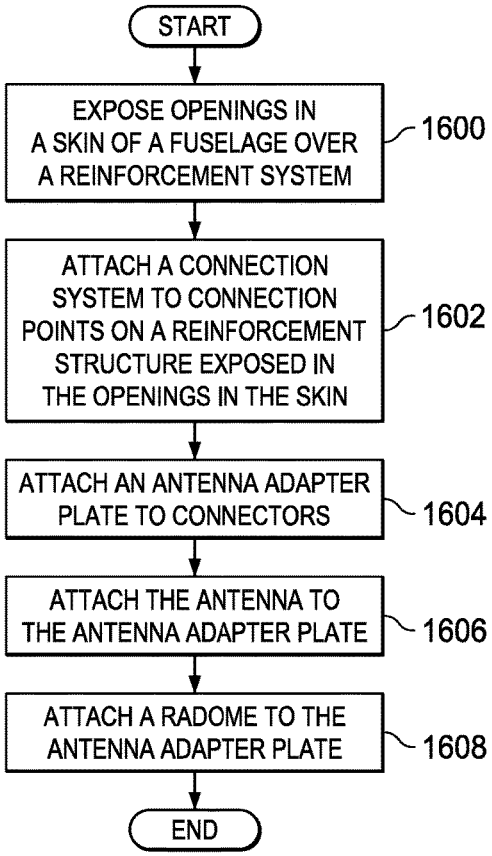
FIG. 16 is an illustration of a flowchart of a process for installing an antenna system to a fuselage of an aircraft in accordance with an illustrative embodiment.

With reference now to FIG. 16, an illustration of a flowchart of a process for installing an antenna system to a fuselage of an aircraft is depicted in accordance with an illustrative embodiment. The process illustrated in FIG. 16 may be implemented in aircraft environment 200 in FIG. 2 to connect antenna system 220 to reinforcement structure 212 in fuselage 204 of aircraft 202.

The process begins by exposing openings in a skin of a fuselage over a reinforcement system (operation 1600). Operation 1600 is performed by removing plugs in the openings. Operation 1600 is an optional step and may be omitted when the antenna system has been selected early enough in the manufacturing process such that covering the openings is unnecessary.

The process attaches a connection system to connection points on a reinforcement structure exposed in the openings in the skin (operation 1602). The connection system comprises connectors that are attached to the connection points on the reinforcement structure. The attachment of the connectors to the connection points may be made using fasteners such as bolts, screws, or other suitable types of fasteners. In other illustrative examples, the attachment may be made through bonding, friction stir welding, or other suitable mechanisms. These connectors may be selected from at least one of a lug, a clevis, or some other type of connector.

The process attaches an antenna adapter plate to connectors (operation 1604). The antenna plate adapter may be connected to the connectors in operation 1604 using fasteners. The fasteners may include, for example, at least one of a bolt, a concentric pin, or other suitable types of fasteners. The process attaches the antenna to the antenna adapter plate (operation 1606). The process then attaches a radome to the antenna adapter plate (operation 1608) with the process terminating thereafter.

Figure 17:
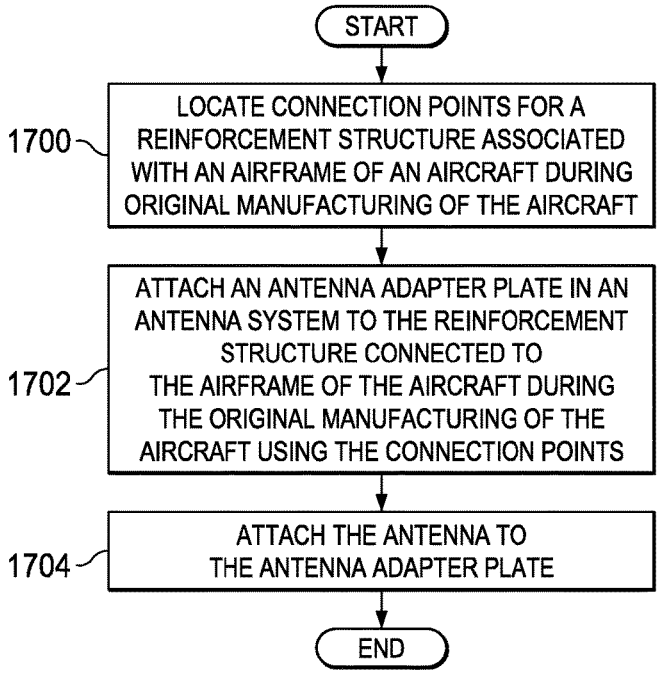
FIG. 17 is an illustration of a flowchart of a process for retrofitting an aircraft in accordance with an illustrative embodiment.

With reference now to FIG. 17, an illustration of a flowchart of a process for retrofitting an aircraft is depicted in accordance with an illustrative embodiment. The process illustrated in FIG. 17 may be implemented in aircraft environment 200 in FIG. 2 to connect antenna system 220 to reinforcement structure 212 in fuselage 204 of aircraft 202 after aircraft 200 has been completed, delivered to a customer, or has already been in use.

The process begins by locating connection points for a reinforcement structure associated with an airframe of an aircraft during original manufacturing of the aircraft (operation 1700). The reinforcement structure is associated with the airframe during the manufacturing of the aircraft and accommodates forces from an antenna system attached to the reinforcement structure. Further, the antenna system includes an antenna selected from a plurality of types of antennas.

The process attaches an antenna adapter plate in an antenna system to the reinforcement structure connected to the airframe of the aircraft during the original manufacturing of the aircraft using the connection points (operation 1702). The process attaches the antenna to the antenna adapter plate (operation 1704) with the process terminating thereafter. The antenna adapter plate is configured to receive any one of the plurality of types of antennas. The reinforcement structure is configured to handle loads from any one of the plurality of types of antennas and the antenna adapter plate attached to the connection points.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent at least one of a module, a segment, a function, or a portion of an operation or step. For example, one or more of the blocks may be implemented as program code, hardware, or a combination of the program code and hardware. When implemented in hardware, the hardware may, for example, take the form of integrated circuits that are manufactured or configured to perform one or more operations in the flowcharts or block diagrams. When implemented as a combination of program code and hardware, the implementation may take the form of firmware. Each block in the flowcharts or the block diagrams may be implemented using special purpose hardware systems that perform the different operations or combinations of special purpose hardware and program code run by the special purpose hardware.

In some alternative implementations of an illustrative embodiment, the function or functions noted in the blocks may occur out of the order noted in the figures. For example, in some cases, two blocks shown in succession may be performed substantially concurrently, or the blocks may sometimes be performed in the reverse order, depending upon the functionality involved. Also, other blocks may be added in addition to the illustrated blocks in a flowchart or block diagram.

For example, operation 1604 and operation 1606 in FIG. 16 may be performed in reverse order. The antenna may be attached to the antenna adapter plate prior to attaching an adapter plate to the connection points. As another example, operation 1702 and operation 1704 in FIG. 17 may be performed in the reverse order. As another example, other operations may be performed as part of the process in FIG. 17. These operations include attaching a radome, attaching a skirt, or attaching node components to the antenna system.

Figure 18:
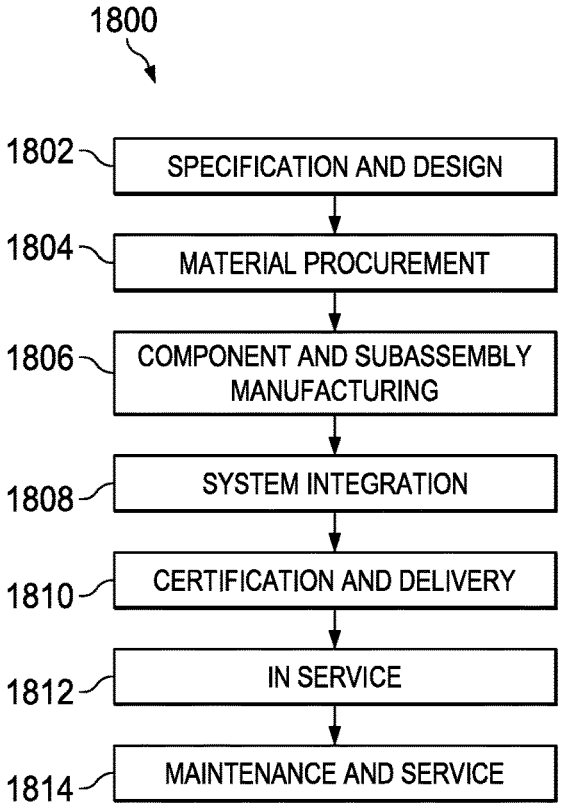
FIG. 18 is an illustration of a block diagram of an aircraft manufacturing and service method in accordance with an illustrative embodiment.
Figure 19:
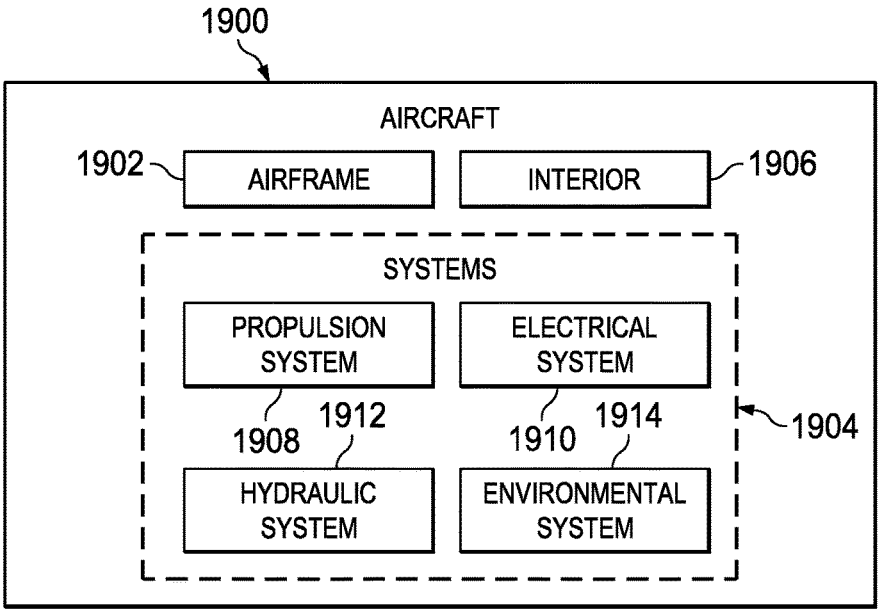
FIG. 19 is an illustration of a block diagram of an aircraft in which an illustrative embodiment may be implemented.

The illustrative embodiments of the present disclosure may be described in the context of aircraft manufacturing and service method 1800 as shown in FIG. 18 and aircraft 1900 as shown in FIG. 19. Turning first to FIG. 18, an illustration of a block diagram of an aircraft manufacturing and service method is depicted in accordance with an illustrative embodiment. During pre-production, aircraft manufacturing and service method 1800 may include specification and design 1802 of aircraft 1900 in FIG. 19 and material procurement 1804. In FIG. 2, reinforcement system 210 may be designed for use with aircraft 202 during specification and design 1802.

During production, component and subassembly manufacturing 1806 and system integration 1808 of aircraft 1900 in FIG. 19 takes place. With the use of reinforcement system 210, antenna system 220 in FIG. 2 may be installed in aircraft 1900 during system integration 1808 with any one of a plurality of types of antennas 206 in FIG. 2 with reinforcement system 210 already in place prior to selection of a type of antenna for antenna system 220.

Thereafter, aircraft 1900 in FIG. 19 may go through certification and delivery 1810 in order to be placed in service 1812. While in service 1812 by a customer, aircraft 1900 is scheduled for routine maintenance and service 1814, which may include modification, reconfiguration, refurbishment, and other maintenance or service.

Further, with reinforcement system 210 in FIG. 2, aircraft 1900 may be retrofitted with antenna system 220 including antenna 222 in FIG. 2 selected from any one of the plurality of types of antennas 206. The installation of antenna system 220 may be performed without needing additional changes to airframe 208 or reinforcement structure 212 when antenna 222 is selected from any one of the plurality of types of antennas 206.

Additionally, with reinforcement structure 212, antenna 222 may be replaced with another antenna selected from the plurality of types of antennas 206 during the life cycle of the aircraft, such as a retrofit of the aircraft. Further, in some cases, antenna 222 may never be attached to reinforcement structure 212. As described above, the use of at least one of plugs or cover plates may result in a skin of the aircraft being as smooth as desired for operation without attaching antenna 222.

Each of the processes of aircraft manufacturing and service method 1800 may be performed or carried out by a system integrator, a third party, an operator, or some combination thereof. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 19, an illustration of a block diagram of an aircraft is depicted in which an illustrative embodiment may be implemented. In this example, aircraft 1900 is produced by aircraft manufacturing and service method 1800 in FIG. 18 and may include airframe 1902 with plurality of systems 1904 and interior 1906. Examples of systems 1904 include one or more of propulsion system 1908, electrical system 1910, hydraulic system 1912, and environmental system 1914. Any number of other systems may be included. Although an aerospace example is shown, different illustrative embodiments may be applied to other industries, such as the automotive industry.

The apparatuses and methods embodied herein may be employed during at least one of the stages of aircraft manufacturing and service method 1800 in FIG. 18. In one illustrative example, components or subassemblies produced in component and subassembly manufacturing 1806 in FIG. 18 may be fabricated or manufactured in a manner similar to components or subassemblies produced while aircraft 1900 is in service 1812 in FIG. 18. As yet another example, one or more apparatus embodiments, method embodiments, or a combination thereof may be utilized during production stages, such as component and subassembly manufacturing 1806 and system integration 1808 in FIG. 18. One or more apparatus embodiments, method embodiments, or a combination thereof may be utilized while aircraft 1900 is in service 1812, during maintenance and service 1814 in FIG. 18, or both.

For example, the installation of antenna system 220 in FIG. 2 occurs during system integration 1808 or maintenance and service 1814 using antenna 222 in FIG. 2 selected from any one of the plurality of types of antennas 206 for which reinforcement structure 212 in FIG. 2 was designed to support. The use of a number of the different illustrative embodiments may substantially expedite the assembly of aircraft 1900, reduce the cost of aircraft 1900, or both expedite the assembly of aircraft 1900 and reduce the cost of aircraft 1900.

Thus, the illustrative examples provide one or more technical solutions that overcome a technical problem with increasing flexibility for customers selecting options for an aircraft. The one or more technical solutions may provide a technical effect allowing customers to select antenna systems at a later point in time during the manufacturing of aircraft without impacting the cost or time to manufacture the aircraft in an undesired manner. Further, one or more illustrative examples also provide a technical effect in which the plurality of different types of antennas may be selected for installation as part of a retrofit after the aircraft has already been in use.

By using a reinforcement system that is designed to support a plurality of types of antennas, an antenna system selecting any one of those plurality of types of antennas may be installed at a later point during manufacturing as compared to currently used manufacturing techniques in which changes to the airframe are performed only for a specific type of antenna. Further, this type of configuration for the reinforcement structure allows for the installation of the antenna system with any one of the plurality of types of antennas at a later point in time, such as during maintenance and service for the aircraft as part of a retrofit of the aircraft.

The descriptions of the different illustrative embodiments have been presented for purposes of illustration and description and are not intended to be exhaustive or limited to the embodiments in the form disclosed. The different illustrative examples describe components that perform actions or operations. In an illustrative embodiment, a component may be configured to perform the action or operation described. For example, the component may have a configuration or design for a structure that provides the component an ability to perform an action or operation that is described in the illustrative examples as being performed by the component.

Further, the ability to install antenna systems afterwards, remove antenna systems, and change antennas in antenna systems provides increased inflexibility with respect to the aircraft using reinforcement structures and the antenna systems as described in the illustrative examples. Thus, value of the aircraft over the life cycle of the aircraft may be higher than with other currently available aircraft.

Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a reinforcement structure associated with an airframe for a fuselage of an aircraft, wherein the reinforcement structure is configured to accommodate forces from an antenna system attached to the reinforcement structure, wherein the antenna system includes an antenna selected from a plurality of types of antennas; and connection points on the reinforcement structure, wherein the connection points are for attachment of an antenna adapter plate in the antenna system in which the antenna adapter plate is configured to receive any one of the plurality of types of antennas;

wherein the reinforcement structure is affixed to and beneath a skin of the airframe for the fuselage of the aircraft.

2. The apparatus of claim 1 further comprising:

an interface in the reinforcement structure configured to receive a group of lines for the plurality of types of antennas, wherein the group of lines pass through holes in the reinforcement structure and connect to a communications system in the aircraft.

3. The apparatus of claim 1, wherein the antenna adapter plate is attached to the reinforcement structure by lugs attached to the connection points and the antenna adapter plate is attached to the lugs.

4. The apparatus of claim 3, wherein the antenna adapter plate is attached to the lugs using at least one of a group of bolts or a group of concentric pins.

5. The apparatus of claim 1, wherein the reinforcement structure comprises at least one of intercostals, shear ties, or frame reinforcements.

6. The apparatus of claim 1, wherein the plurality of types of antennas is configured to provide communications to at least one of a passenger cabin or a flight deck in the aircraft.

7. The apparatus of claim 1, wherein the forces are selected from at least one of a load or a stress.

8. The apparatus of claim 1, wherein the reinforcement structure is associated with the airframe during manufacturing of the aircraft.

9. The apparatus of claim 1, wherein the connection points are covered by plugs installed in a skin of the fuselage during manufacturing of the aircraft and the plugs are removed prior to installing the antenna system.

10. The apparatus of claim 1 further comprising:

a radome configured to be attached to the antenna adapter plate, wherein the radome covers the antenna when attached to the antenna adapter plate.

11. The apparatus of claim 1, wherein the plurality of types of antennas is selected from a group comprising a Ku-band antenna, a K-band antenna, and a Ka-band antenna.

12. An antenna system comprising:

an antenna adapter plate configured to receive any one of a plurality of types of antennas used to provide a communications link to the Internet;

lugs configured to be attached to connection points on a reinforcement structure associated with an airframe of an aircraft, wherein the reinforcement structure is configured to accommodate forces from any one of the plurality of types of antennas; and a group of concentric pins configured to connect a group of the connection points to the lugs.

13. The antenna system of claim 12 further comprising:

an antenna attached to the antenna adapter plate, wherein the antenna is selected from the plurality of types of antennas.

14. The antenna system of claim 12 further comprising:

a radome configured to be attached to the antenna adapter plate, wherein the radome covers the antenna when attached to the antenna adapter plate, wherein the radome is formed from a group of materials selected to reduce attenuation of electromagnetic signals for any one of the plurality of types of antennas.

15. A method for retrofitting an aircraft, the method comprising:

locating connection points for a reinforcement structure associated with an airframe of the aircraft, wherein the reinforcement structure is associated with the airframe during original manufacturing of the aircraft and accommodates forces from an antenna system attached to the reinforcement structure, wherein the antenna system includes an antenna selected from a plurality of types of antennas;

attaching an antenna adapter plate in the antenna system to the reinforcement structure connected to the airframe of the aircraft during the original manufacturing of the aircraft using the connection points; and attaching the antenna to the antenna adapter plate, wherein the antenna adapter plate is configured to receive any one of the plurality of types of antennas, and wherein the reinforcement structure is configured to handle loads from any one of the plurality of types of antennas and the antenna adapter plate attached to the connection points;

wherein the reinforcement structure is affixed to and beneath a skin of the airframe for the fuselage of the aircraft.

16. The method of claim 15, wherein attaching the antenna adapter plate to the reinforcement structure comprises:

attaching lugs to the connection points; and attaching the antenna adapter plate to the lugs.

17. The method of claim 16, wherein the antenna adapter plate is attached to the lugs using at least one of a group of bolts or a group of concentric pins.

18. The method of claim 16 further comprising:

attaching a radome to the antenna adapter plate, wherein the radome covers the antenna when attached to the antenna adapter plate.

19. The method of claim 15, wherein the reinforcement structure includes an interface configured to receive a group of lines for any one of the plurality of types of antennas.

20. The method of claim 15, wherein the reinforcement structure comprises at least one of intercostals, shear ties, or frame reinforcements.

21. The method of claim 15, wherein the plurality of types of antennas is configured to provide communications to at least one of a passenger cabin or a flight deck in the aircraft.

22. The method of claim 15, wherein the forces are selected from at least one of a load or a stress.

23. An apparatus comprising:

a reinforcement structure associated with an airframe for a fuselage of an aircraft, wherein the reinforcement structure is configured to accommodate forces from an antenna system attached to the reinforcement structure, wherein the antenna system includes an antenna selected from a plurality of types of antennas;

connection points on the reinforcement structure, wherein the connection points are for attachment of an antenna adapter plate in the antenna system in which the antenna adapter plate is configured to receive any one of the plurality of types of antennas; and an interface in the reinforcement structure configured to receive a group of lines for the plurality of types of antennas, wherein the group of lines pass through holes in the reinforcement structure and connect to a communications system in the aircraft.

24. An apparatus comprising:

a reinforcement structure associated with an airframe for a fuselage of an aircraft, wherein the reinforcement structure is configured to accommodate forces from an antenna system attached to the reinforcement structure, wherein the antenna system includes an antenna selected from a plurality of types of antennas; and connection points on the reinforcement structure, wherein the connection points are for attachment of an antenna adapter plate in the antenna system in which the antenna adapter plate is configured to receive any one of the plurality of types of antennas;

wherein the connection points are covered by plugs installed in a skin of the fuselage during manufacturing of the aircraft and the plugs are removed prior to installing the antenna system.

* * * * *